US006010334A

United States Patent [19]

Mifune et al.

[11] Patent Number: 6,010,334

[45] Date of Patent: Jan. 4, 2000

[54] COMBUSTION APPLIANCE FOR LIQUID FUEL

[75] Inventors: Hideo Mifune; Yasuaki Nakamura; Yosimitsu Kaga; Takashi Tsukamoto, all of Shizuoka-ken, Japan

[73] Assignee: Tokai Corporation, Shizuoka-ken, Japan

[21] Appl. No.: 09/091,436

[22] PCT Filed: Oct. 27, 1997

[86] PCT No.: PCT/JP97/03885

§ 371 Date: Jun. 29, 1998

§ 102(e) Date: Jun. 29, 1998

[87] PCT Pub. No.: WO98/19109

PCT Pub. Date: May 7, 1998

[30] Foreign Application Priority Data

Oct. 30, 1996 [JP] Japan ..... 8-288423

[51] Int. Cl.[7] ..... F23D 14/28; F23D 3/28; F23N 5/00

[52] U.S. Cl. ..... 431/344; 431/315; 431/304; 431/322; 431/150; 431/153; 431/325; 431/35; 431/86; 126/96; 239/50

[58] Field of Search ..... 431/344, 301, 431/302, 304, 305, 306, 307, 308, 298, 153, 150, 315, 320, 322, 325, 129, 130, 144, 12, 152, 326, 327, 328, 35, 86, 120; 126/45, 46, 96, 97; 239/44, 45, 49, 50

[56] References Cited

U.S. PATENT DOCUMENTS

| | | | |
|---|---|---|---|
| 184,434 | 11/1876 | Sanford | 431/325 |
| 2,459,042 | 1/1949 | Nave et al. | 431/315 |
| 2,651,931 | 9/1953 | Gailmard, Sr. et al. | 431/315 |
| 4,416,616 | 11/1983 | Shimizu et al. | 431/325 |
| 4,427,365 | 1/1984 | Kotera et al. | 126/96 |
| 4,518,347 | 5/1985 | Sonetaka et al. | 431/325 |
| 4,569,656 | 2/1986 | Shimizu et al. | 431/325 |
| 4,836,773 | 6/1989 | Yamaguchi | 431/325 |

FOREIGN PATENT DOCUMENTS

| | | | |
|---|---|---|---|
| 845639 | 8/1960 | European Pat. Off. | 431/325 |
| 1-123903 | 5/1989 | Japan | 431/315 |

*Primary Examiner*—Ira S. Lazarus
*Assistant Examiner*—Josiah C. Cocks
*Attorney, Agent, or Firm*—Baker & Botts, LLP

[57] ABSTRACT

In a combustion appliance provided with a combustion wick for sucking up a liquid fuel by the utilization of capillarity and burning it, functions for automatically extinguishing the fire after the combustion has been carried out for a predetermined length of time are constituted with a simple mechanism. The combustion wick (6), which comprises a sucking section for sucking up a liquid fuel by the utilization of capillarity and a burning section for burning the sucked-up liquid fuel, is divided at an intermediate position into a burning section side subdivision (6A) and a sucking section side subdivision (6B). The combustion wick (6) is located such that at least either one of the subdivisions can be moved in a direction that comes into contact with the other and in a direction that separates from the other. The fuel is fed from the sucking section side subdivision (6B) to the burning section side subdivision (6A) when they are brought into contact with each other. The feeding of the fuel is blocked when the subdivisions are separated from each other, and a combustion time is thereby limited.

10 Claims, 12 Drawing Sheets

COMBUSTION APPLIANCE FOR LIQUID FUEL

TECHNICAL FIELD

This invention relates to a combustion appliance for a liquid fuel, which is provided with a combustion wick for sucking up a liquid fuel, such as an alcohol fuel, and burning it.

This invention particularly relates to combustion appliances, such as lighters for smoker's requisites, other types of lighters, torches, lanterns, and other types of illumination devices, which utilize liquid fuels, such as alcohols, benzine types of hydrocarbons, or petroleum types of hydrocarbons, and which have a constitution such that the combustion time may be limited and the fire may be extinguished after the fuel has been burned for a predetermined length of time.

BACKGROUND ART

Ordinarily, as fuels in combustion appliances, such as lighters for smoker's requisites, other types of lighters, torches, and illumination devices, alcohol fuels, such as ethyl alcohol, petroleum benzine types of benzine fuels, or liquefied gas fuels, such as butane gas or propane gas, have heretofore been utilized.

The performances, the levels of convenience of handling, and the design structures of the combustion appliances vary in accordance with the kinds of the fuels used, and the fuels have their own features. For example, in cases where the liquefied gas fuels are used as the liquid fuels, since the liquefied gas fuels have a high gas pressure at temperatures falling within the range, in which the combustion appliance is used, the vessel for storing the fuels must have a pressure-resistant structure. Also, the flame length varies in accordance with variations in gas pressure. In particular, the liquefied gas fuels have the characteristics such that their gas pressures markedly vary logarithmically with respect to temperatures, and therefore the problems occur in that the flame length changes markedly, depending upon temperatures. In order for the change in flame length to be reduced, a special design countermeasure for carrying out temperature compensation for a fuel feeding mechanism of the combustion appliance must be taken. Therefore, the structure cannot be kept simple, and the cost cannot be kept low.

As for the liquid fuels, such as the alcohol fuels, they are liquids at normal temperatures and have comparatively low vapor pressures. Therefore, the fuel storing section need not have a pressure-resistant structure. Accordingly, the structure of the combustion appliance can be kept simple, and the cost can be kept comparatively low. In the combustion appliances for the liquid fuels, ordinarily, as means for feeding the liquid fuel from the fuel storing section to the burning section, a combustion wick, which sucks up the liquid fuel with the capillarity through open pores or through minute spaces formed between thin fibers in a fiber bundle and by the utilization of the surface tension of liquid fuel and allows the liquid fuel to burn at a top end portion of the wick, has heretofore been used. Specifically, in the combustion wick, the liquid fuel is sucked up by the utilization of a string-like wick formed by twisting fibers, a bundle of glass fibers, a wick formed by bundling glass fibers with cotton threads and interweaving thin metal wires for preventing the bundle from becoming loose, or the like. The lower end portion of the combustion wick has the functions for sucking up the liquid fuel, and the sucked-up fuel is burned at the top end portion of the wick.

Gas lighters utilizing a liquefied gas as the fuel, which are provided with mechanisms designed such that the fire may be extinguished automatically after a predetermined amount of fuel has been burned, have been proposed in, for example, Japanese Unexamined Patent Publication Nos. 7(1995)-190356, 7(1995)-158852, and 8(1996)-219456. The automatic fire extinguishing functions are constituted for various purposes. The mechanisms are designed such that a valve body may be operated in association with a lighting operation and the fuel gas fed from a fuel tank may be measured and burned.

However, with the mechanisms for burning a predetermined amount of fuel in the aforesaid gas lighters utilizing a liquefied gas, since the liquefied gas utilized as the fuel is stored in a high-pressure state in the fuel tank, it is difficult to measure a predetermined amount of fuel. Due to the difficulty in measuring a predetermined amount of fuel and the aforesaid fluctuation in gas pressure with respect to temperatures, a large variation in combustion time occurs. Also, the problems occur in that a valve mechanism having a complicated structure must be used and the cost cannot be kept low.

Accordingly, the object of the present invention is to provide a combustion appliance for a liquid fuel, which has functions for carrying out combustion of a predetermined amount of fuel, i.e. the combustion for a predetermined length of time, and thereafter extinguishing the fire.

One of applications, in which it is desired that the combustion flame be extinguished after the combustion has been carried out for a predetermined length of time, is a lighter for smoker's requisites wherein, after a tobacco has been lighted, the combustion flame which is not necessary any more is to be extinguished. In such cases, for the lighting of the tobacco, it is sufficient for the combustion for several seconds to be carried out. When a tobacco lighting failure is taken into consideration, it is sufficient for the fuel to burn for 10 seconds or at most 20 seconds. Longer combustion time results in waste of the fuel and partial overheating and damage of constituent parts of the lighter. In order for such problems to be eliminated, the fire should preferably be extinguished after the combustion has been carried out for a predetermined length of time.

As described above, examples of the combustion appliances for a liquid fuel, which are provided with a combustion wick for sucking up a liquid fuel and burning it, include lighters for smoker's requisites, other types of lighters, and various types of illumination devices. ordinarily, such combustion appliances for a liquid fuel are provided with a mechanism for extinguishing the combustion flame by carrying out a particular fire extinguishing operation after the lighting. However, from the view point of operability, it is often desired that the fire goes out automatically after the combustion having been begun by the lighting operation has continued for a predetermined length of time. Also, in the cases of several combustion appliances, it may be desired that the fire goes out after a fire extinguishing operation has been carried out and the combustion has then been continued for a predetermined length of time. Further, in other combustion appliances, it may be desired that the continuous combustion is continued for a length of time having been set with a timer and thereafter the fire is extinguished automatically by the operation of the timer.

DISCLOSURE OF INVENTION

A combustion appliance for a liquid fuel in accordance with the present invention, which solves the problems described above, is characterized by dividing a combustion wick, which comprises a sucking section for sucking up a liquid fuel by the utilization of capillarity and a burning section for burning the sucked-up liquid fuel, at an intermediate position into a sucking section side subdivision and a burning section side subdivision, and locating the combustion wick such that at least either one of the sucking section side subdivision and the burning section side subdivision can be moved in a direction that comes into contact with the other and in a direction that separates from the other, the liquid fuel being fed from the sucking section side subdivision to the burning section side subdivision when they are brought into contact with each other, the feeding of the liquid fuel being blocked when the sucking section side subdivision and the burning section side subdivision are separated from each other, whereby a combustion time is limited.

With the aforesaid combustion appliance in accordance with the present invention, in its non-use state, the two subdivisions are in contact with each other, and the fuel is fed from the sucking section side subdivision to the burning section side subdivision. Before the combustion is begun or after the combustion has been begun, the two subdivisions are separated from each other, and the feeding of the fuel to the burning section side subdivision is thereby ceased. In this state, the liquid fuel having permeated to the burning section side subdivision is used for the combustion. Thereafter, the combustion flame goes out.

From the view point of eliminating the necessity of a fire extinguishing operation, the separation of the sucking section side subdivision and the burning section side subdivision from each other should preferably be carried out in association with an operation for lighting the combustion wick.

The present invention also provides a combustion appliance for a liquid fuel, characterized by dividing a combustion wick, which comprises a sucking section for sucking up a liquid fuel by the utilization of capillarity and a burning section for burning the sucked-up liquid fuel, at an intermediate position into a sucking section side subdivision and a burning section side subdivision, and locating the combustion wick such that at least either one of the sucking section side subdivision and the burning section side subdivision can be moved in a direction that comes into contact with the other and in a direction that separates from the other, the movements being carried out in association with opening and closing operations of a closure cap for closing the burning section, the liquid fuel being fed from the sucking section side subdivision to the burning section side subdivision when they are brought into contact with each other, the feeding of the liquid fuel being blocked when the sucking section side subdivision and the burning section side subdivision are separated from each other, whereby a combustion time is limited.

The last-mentioned combustion appliance in accordance with the present invention should preferably be constituted such that the burning section side subdivision of the combustion wick may be urged by a resilient means to the direction that separates from the sucking section side subdivision, and such that the burning section side subdivision may be moved in the direction that comes into contact with the sucking section side subdivision and in association with the closing operation of the closure cap. Alternatively, the last-mentioned combustion appliance in accordance with the present invention may be constituted such that the burning section side subdivision of the combustion wick may be brought into contact with the sucking section side subdivision when the closure cap is closed, and such that the burning section side subdivision may be moved in the direction that separates from the sucking section side subdivision and in association with the opening operation of the closure cap.

With the last-mentioned combustion appliance in accordance with the present invention, the burning section side subdivision of the combustion wick is separated from the sucking section side subdivision in association with the operation for opening the closure cap, and the feeding of the fuel to the burning section side subdivision is thereby ceased. In this state, the combustion is carried out for a length of time corresponding to the amount of the fuel having permeated to the burning section side subdivision. Thereafter, the combustion flame goes out.

In the aforesaid combustion appliances for a liquid fuel in accordance with the present invention, a fuel reservoir may be located at an intermediate position in the combustion wick, and the combustion wick may be divided at a position closer to the sucking section than the fuel reservoir. In such cases, the combustion time can be prolonged.

Also, the divided end faces of the combustion wick should preferably constitute oblique surfaces or curved surfaces. In such cases, the area of contact of the sucking section side subdivision and the burning section side subdivision can be set to be large. Therefore, the rate, at which the fuel is fed from the sucking section side subdivision to the burning section side subdivision when they are brought into contact with each other, can be set to be high.

Further, as for the position, at which the combustion wick is divided, in cases where the burning section and the sucking section of the combustion wick are made from different materials, the combustion wick may be divided at an intermediate position in the material, which constitutes the burning section, into the sucking section side subdivision and the burning section side subdivision, such that at least either one of the sucking section side subdivision and the burning section side subdivision can be moved in the direction that comes into contact with the other and in the direction that separates from the other. Alternatively, the combustion wick may be divided at an intermediate position in the material, which constitutes the sucking section, into the sucking section side subdivision and the burning section side subdivision, such that at least either one of the sucking section side subdivision and the burning section side subdivision can be moved in the direction that comes into contact with the other and in the direction that separates from the other. As another alternative, the combustion wick may be divided at a boundary between the material, which constitutes the sucking section, and the material, which constitutes the burning section, into the sucking section side subdivision and the burning section side subdivision, such that at least either one of the sucking section side subdivision and the burning section side subdivision can be moved in the direction that comes into contact with the other and in the direction that separates from the other. In cases where the burning section and the sucking section of the combustion wick are made from the same material, the combustion wick may be divided at an arbitrary intermediate position in accordance with a desired combustion time.

The separation of the sucking section side subdivision and the burning section side subdivision of the combustion wick from each other may be carried out before the burning section is lighted. Alternatively, the separation may be carried out at the time, at which the burning section is lighted, or after the burning section has been lighted, in association with the lighting operation. As another alternative, the separation may be carried out manually after the burning section has been lighted. As further alternative, the separation may be carried out in association with a timer and at the time, at which the period set by the timer has elapsed.

The liquid fuel may be an alcohol type of fuel, such as a fuel containing, as a principal constituent, a lower monohydric alcohol selected from the group consisting of methyl alcohol, ethyl alcohol, and propyl alcohol, and containing a saturated hydrocarbon, such as hexane or heptane, for coloring the flame. Alternatively, a benzine type of hydrocarbon, a petroleum type of hydrocarbon, or the like, may be employed as the liquid fuel.

With the combustion appliances for a liquid fuel in accordance with the present invention, a liquid fuel is utilized as the fuel, and the combustion wick is divided into the two subdivisions, such that at least either one of the two subdivisions can be moved in the direction that comes into contact with the other and in the direction that separates from the other. Therefore, the mechanism, with which the combustion flame is extinguished after the combustion has been carried out for a predetermined length of time, can be kept simple. Specifically, in the cases of the combustion appliance utilizing the liquid fuel, the lower end portion of the combustion wick serves as the fuel sucking section utilizing the capillarity, the fuel is fed through the sucking section to the burning section, and the combustion is thereby continued. In cases where the combustion wick is divided at an intermediate position, and the feeding of the fuel from the sucking section side subdivision to the burning section side subdivision is ceased, the fire can be extinguished automatically when the fuel, which has been retained in the burning section side subdivision, burns out. Since the fire is thus extinguished after the combustion has been continued for a predetermined length of time, the amount of the fuel used for the combustion can be kept small, and the number of times of fuel use can be kept large. Also, the combustion appliance can be prevented from being overheated. Therefore, the combustion appliances for a liquid fuel in accordance with the present invention have an enhanced value as an article of commerce.

BEST MODE OF CARRYING OUT THE INVENTION

Embodiments of the combustion appliance for a liquid fuel in accordance with the present invention will be described hereinbelow with reference to the accompanying drawings.

<First embodiment>

Figure 1:
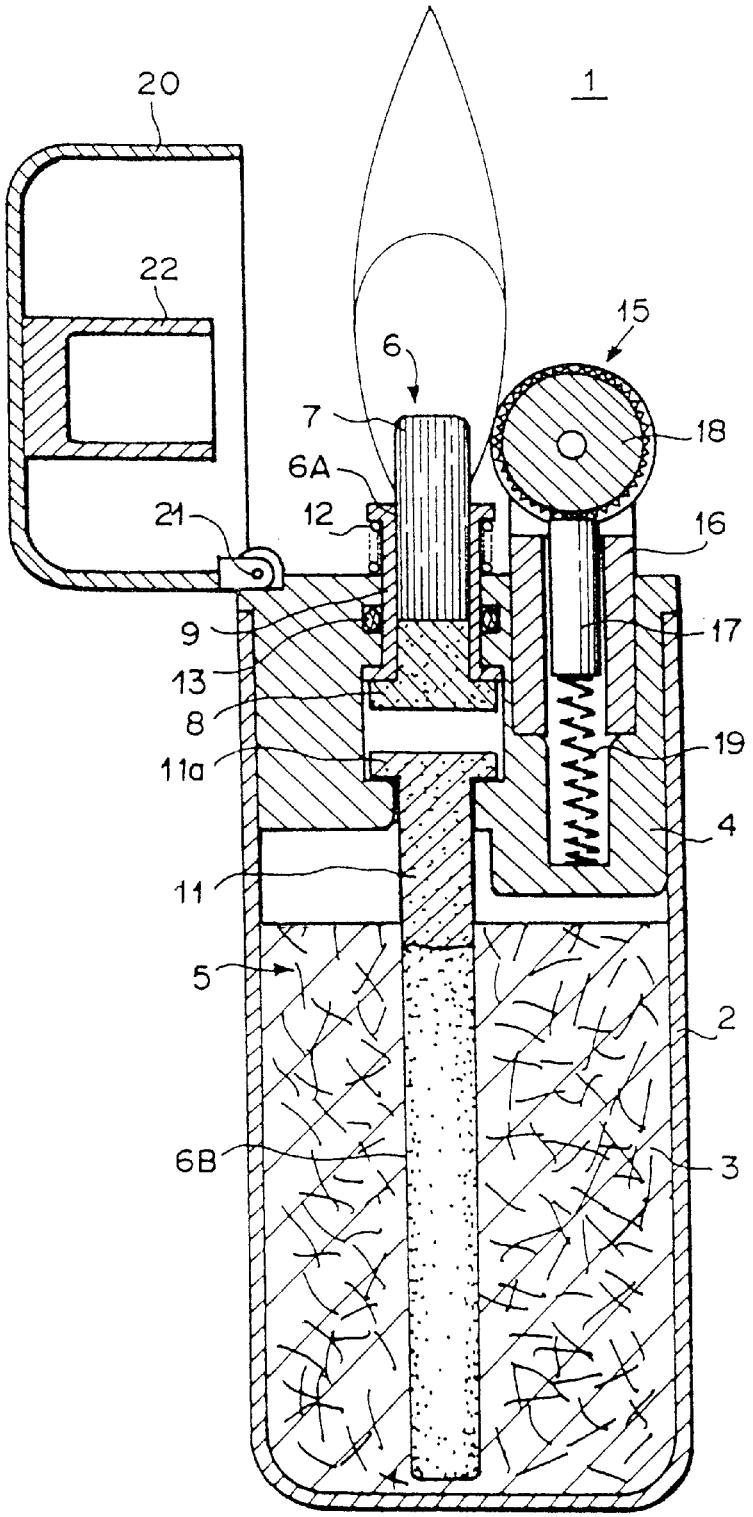
FIG. 1 is a schematic sectional view showing a first embodiment of the combustion appliance for a liquid fuel in accordance with the present invention, which takes on the form of a lighter and is in a combustion state.
Figure 2:
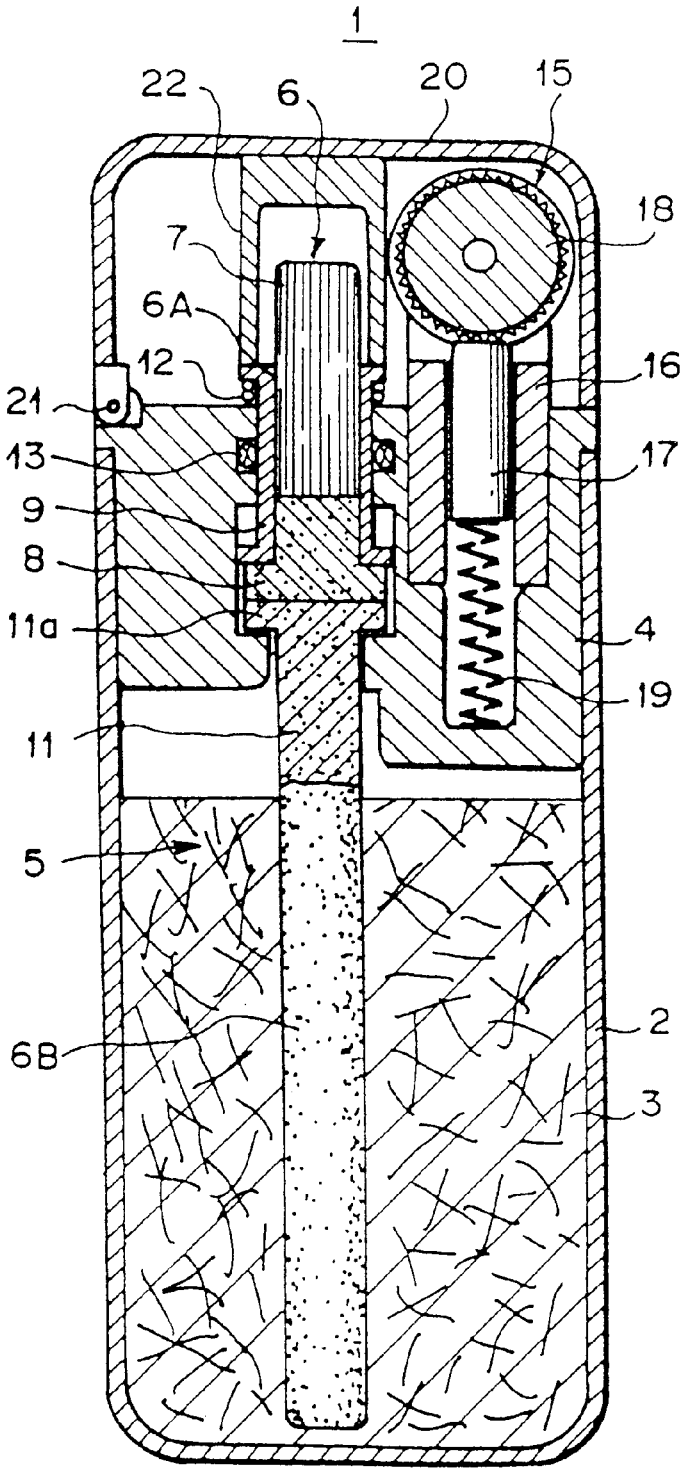
FIG. 2 is a schematic sectional view showing the lighter of FIG. 1, which is in a non-use state.

FIGS. 1 and 2 show a schematic sectional structure of a first embodiment of the combustion appliance for a liquid fuel in accordance with the present invention, which takes on the form of a lighter for smoker's requisites. FIG. 1 shows the lighter in a combustion state, and FIG. 2 shows the lighter in a non-use state. In the drawings, parts mounting structures, and the like, are not shown in detail, and only the principles of the mechanisms are shown.

In this embodiment, a lighter 1 is provided with a bottomed case-like tank 2. A fiber material 3 (wadding) is inserted into the tank 2. An upper cover 4 is secured to the upper part of the tank 2. In this manner, the fuel storing section 5 for storing the liquid fuel is formed.

By way of example, the tank 2 is constituted of a molded product of polypropylene and has an internal volume of 5 $cm^3$. As the fiber material 3, polypropylene fibers having a thickness of 1 to 2 denier are pushed at a density of 0.1 $g/cm^3$ into the tank 2. Also, 4 cc of the liquid fuel is injected into the tank 2, the fiber material 3 is thus impregnated with the liquid fuel, and the liquid fuel is thereby stored in the tank 2. As the liquid fuel, a mixed liquid fuel, which contains 95 wt % of ethyl alcohol and 5 wt % of n-hexane, is employed.

A combustion wick 6 is inserted vertically through a center portion of the upper cover 4 and into the tank 2. The combustion wick 6 is divided at an intermediate position into a burning section side subdivision 6A for burning the fuel at a burning section, which is located at the upper part of the combustion wick 6, and a sucking section side subdivision 6B for sucking up the liquid fuel through a sucking section, which is located at the lower part of the combustion wick 6, and feeding the liquid fuel to the burning section side subdivision 6A.

The burning section side subdivision 6A is supported by the upper cover 4 such that the subdivision 6A can slide vertically. An upper end portion of the sucking section side subdivision 6B is secured to the upper cover 4, and a lower end portion thereof is inserted into the fuel storing section 5.

The burning section side subdivision 6A is slid vertically in the direction, along which the lower end of the subdivision 6A comes into contact with the upper end of the sucking section side subdivision 6B as illustrated in FIG. 2, and in the direction, along which the lower end of the subdivision 6A separates from the upper end of the sucking section side subdivision 6B as illustrated in FIG. 1.

The burning section side subdivision 6A comprises a burning member 7, which is located at the upper part and made from a heat-resistant material, and a fuel retaining member 8, which is located at the lower part and made from a porous material. The burning member 7 and the fuel retaining member 8 are secured to a cylindrical sliding member 9. The sliding member 9 is inserted for the sliding movement into a through-hole of the upper cover 4.

The burning member 7 is made from a sintered porous glass material or a sintered porous ceramic material and is formed in a rod-like shape. The burning member 7 contains open cells (capillary paths) therein. The upper end portion of the burning member 7 is projected by a predetermined length from the top end of the sliding member 9 and constitutes the burning section. The size of the combustion flame is determined by the setting of the length of projection of the burning member 7, the diameter of the burning member 7, and the like.

The fuel retaining member 8 is made from a porous material obtained by sintering polyethylene powder. The upper portion of the fuel retaining member 8 has the same shape as that of the lower end portion of the burning member 7. The upper portion of the fuel retaining member 8 is inserted into the sliding member 9 and secured such that the upper end may be in contact with the lower end of the burning member 7. The lower end portion of the fuel retaining member 8 has an increased cross-sectional area and stands facing the lower end of the sliding member 9. The fuel retaining member 8 serves as a fuel reservoir having a volume capable of retaining an amount of the fuel necessary for obtaining the combustion for a predetermined length of time at the burning section side subdivision 6A.

The sucking section side subdivision 6B is constituted of a sucking member 11, which is made from a porous material obtained by sintering polyethylene powder, the porous material being of the same type as that of the fuel retaining member 8. The sucking member 11 is formed into a rod-like shape having an increased-diameter head 11*a*. The head 11*a* is inserted into the through-hole of the upper cover 4 and engaged with the upper cover 4. The lower end portion of the sucking member 11 is in contact with the fiber material 3 contained in the tank 2 and constitutes the sucking section for sucking up the liquid fuel.

By way of example, the sucking member 11 and the fuel retaining member 8 are formed by introducing the polyethylene powder, which is a mixture of particles having particle sizes of 70 to 200 mesh and has an average particle size of 140 mesh, into a mold, and sintering the polyethylene powder at 170° C. for 10 minutes.

The sucking member 11 of the sucking section side subdivision 6B and the fuel retaining member 8 of the burning section side subdivision 6A may be made from any of other materials, which have the functions for sucking up the liquid fuel by the utilization of the capillarity. Also, the sucking member 11 and the fuel retaining member 8 may be made from different materials. For example, besides the sintered material of the polyethylene powder, a bundled fiber material, a fiber material having been formed into a rod-like shape by use of an adhesive, or the like, may be employed for each of the sucking member 11 and the fuel retaining member 8.

The burning section side subdivision 6A is urged by a coil spring 12, which serves as a resilient means, to the direction that separates from the sucking section side subdivision 6B (i.e., upwardly in FIG. 1). The coil spring 12 is located in a contracted state between the upper surface of the upper cover 4 and the upper end of the sliding member 9. When the burning section side subdivision 6A is moved upwardly by the urging force of the coil spring 12, the lower end of the burning section side subdivision 6A separates from the upper end of the sucking section side subdivision 6B, and a gap is thereby formed therebetween. A sealing material 13 is interposed between the upper cover 4 and the sliding member 9 and seals the through-hole of the upper cover 4.

The sucking section at the lower part of the sucking member 11 of the sucking section side subdivision 6B is brought into contact with the fiber material 3, which is contained in the tank 2. By the utilization of capillarity, the sucking section sucks up the liquid fuel, which is contained in the fiber material 3. The thus sucked-up fuel is fed from the upper end of the sucking section side subdivision 6B into the burning member 7 via the fuel retaining member 8 of the burning section side subdivision 6A, which fuel retaining member is in contact with the upper end of the sucking section side subdivision 6B. The liquid fuel is lighted at the burning section located at the top end portion of the burning member 7 of the burning section side subdivision 6A of the combustion wick 6 and is burned with a flame being produced. As described above, the length of projection of the burning member 7 from the sliding member 9 is adjusted such that a predetermined flame length may be obtained.

A lighting means 15 is fitted into the upper cover 4 such that the lighting means 15 may stand facing the top end portion of the burning member 7 of the burning section side subdivision 6A. The lighting means 15 comprises a bracket 16, which is secured to the upper cover 4, and an ignition stone 17, which is inserted into the bracket 16 such that it can move vertically. The lighting means 15 also comprises a rotatable file 18, which is located at the upper end of the bracket 16, and a stone pushing spring 19, which pushes the ignition stone 17 such that the end of the ignition stone 17 may be pushed against the circumferential surface of the rotatable file 18 by the urging force of the stone pushing spring 19. When the rotatable file 18 is rotated, sparks are thrown out from the ignition stone 17 toward the combustion wick 6.

A closure cap 20 covers the region above the combustion wick 6 and the lighting means 15. The closure cap 20 is pivotably supported for rotation by a pin 21 on one end portion of the upper surface of the upper cover 4. An abutment member 22 is formed on the inner surface of the closure cap 20. The abutment member 22 comes into contact with and pushes the upper end of the sliding member 9 down, which upper end is located at the position corresponding to the burning section side subdivision 6A of the combustion wick 6. As illustrated in FIG. 2, when the closure cap 20 is closed, the abutment member 22 comes into contact with the sliding member 9 and pushes it down against the urging force of the coil spring 12. As a result, the lower end of the fuel retaining member 8 of the burning section side subdivision 6A is brought into contact with the upper end of the sucking member 11 of the sucking section side subdivision 6B. Also, the abutment member 22 covers and closes the portion of the burning member 7, i.e. the burning section, which is projected upwardly from the sliding member 9, and the liquid fuel is thereby prevented from volatilizing.

In the state in which the closure cap 20 is closed as illustrated in FIG. 2, the sucking section side subdivision 6B and the burning section side subdivision 6A of the combustion wick 6 come into contact with each other. Therefore, the liquid fuel, which has been sucked up through the sucking section side subdivision 6B, is fed into the burning section side subdivision 6A and permeates to the fuel retaining member 8 and the burning member 7. In this manner, a predetermined amount of the fuel is retained in the fuel retaining member 8 and the burning member 7. As illustrated in FIG. 1, when the closure cap 20 is opened, the burning section side subdivision 6A is released from the pushing force of the abutment member 22 and is moved upwardly by the urging force of the coil spring 12. As a result, the burning section side subdivision 6A is separated from the sucking section side subdivision 6B, and the feeding of the fuel from the sucking section side subdivision 6B to the burning section side subdivision 6A is blocked.

When the lighting means 15 is operated for lighting the top end portion of the burning member 7, the combustion is carried out with a flame being produced from the top end portion of the burning member 7. At the time at which the fuel having been retained in the burning section side subdivision 6A has been used for the combustion and burns out, the combustion flame goes out automatically. In cases where the closure cap 20 is closed before the fuel having been retained in the burning section side subdivision 6A burns out, the upper portion of the burning member 7 is closed by the abutment member 22 of the closure cap 20, and the fire is extinguished. At the same time, the burning section side subdivision 6A and the sucking section side subdivision 6B come into contact with each other, and the fuel is fed from the sucking section side subdivision 6B into the burning section side subdivision 6A.

In the structure described above, the abutment member 22 of the closure cap 20 closes the upper end portion of the burning section side subdivision 6A. Alternatively, the abutment member 22 may be provided only for moving the burning section side subdivision 6A up and down, and the entire region above the combustion wick 6 and the lighting means 15 may be closed by the closure cap 20. In such cases, the portion, at which the tank 2 or the upper cover 4 comes into contact with the closure cap 20, may be provided with a sealing material, such that the portion may be hermetically sealed and prevents the liquid fuel from volatilizing.

<Second embodiment>

Figure 3:
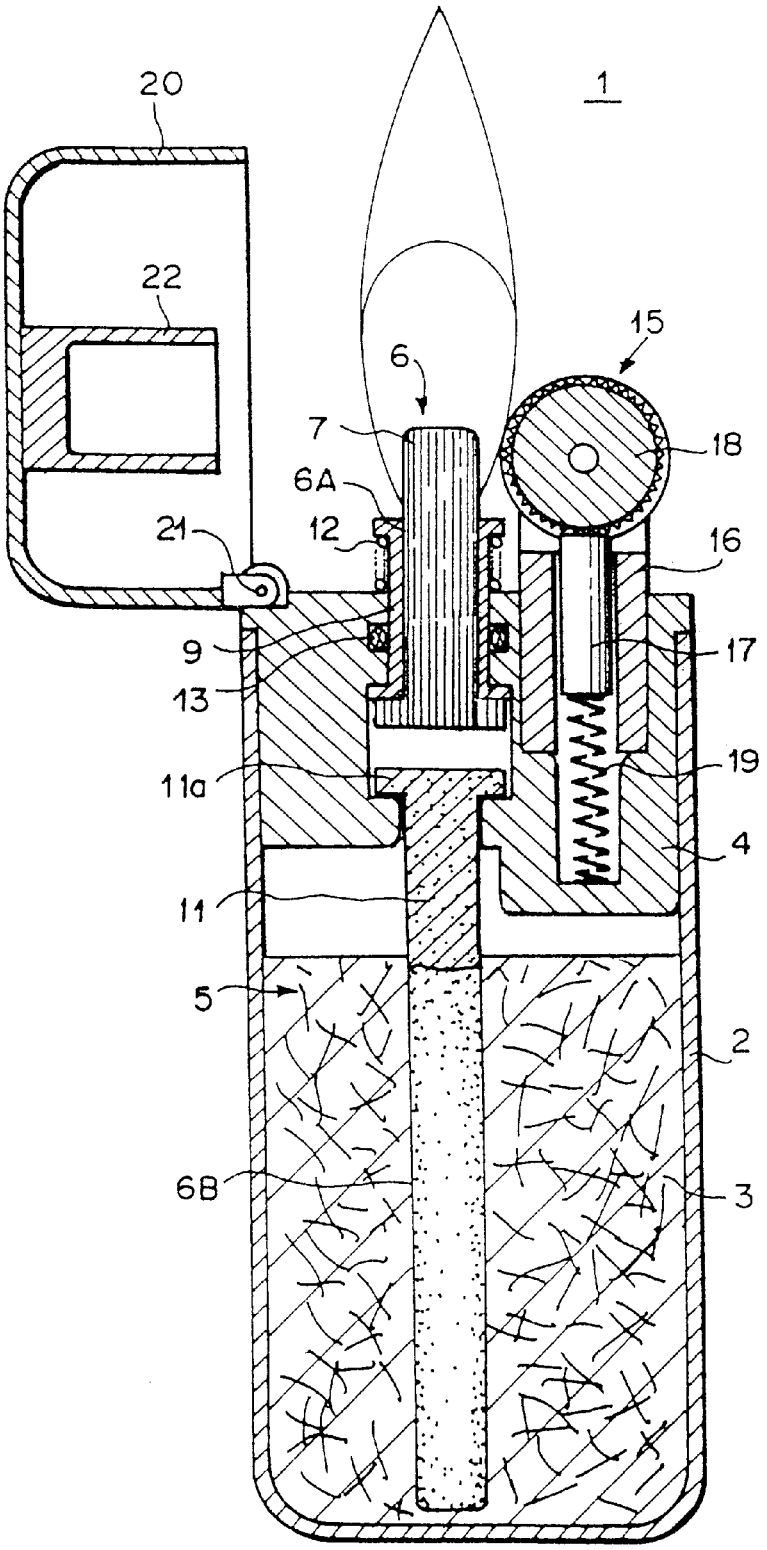
FIG. 3 is a schematic sectional view showing a second embodiment of the combustion appliance for a liquid fuel in accordance with the present invention, which takes on the form of a lighter.

As illustrated in FIG. 3, in the second embodiment of the combustion appliance (the lighter 1), the combustion wick 6 is divided into the burning section side subdivision 6A and the sucking section side subdivision 6B as in the first embodiment. The structure of the burning section side subdivision 6A is different from that in the first embodiment.

The entire region of the burning section side subdivision 6A of the combustion wick 6 is constituted of the burning member 7 made from the heat-resistant material. Specifically, the portion of the burning section side subdivision 6A corresponding to the fuel retaining member 8, which is formed in the first embodiment, is also made from the heat-resistant material. The entire region of the sucking section side subdivision 6B is constituted of the sucking member 11 made from the porous material. The other features are the same as those in the first embodiment.

<Third embodiment>

Figure 4:
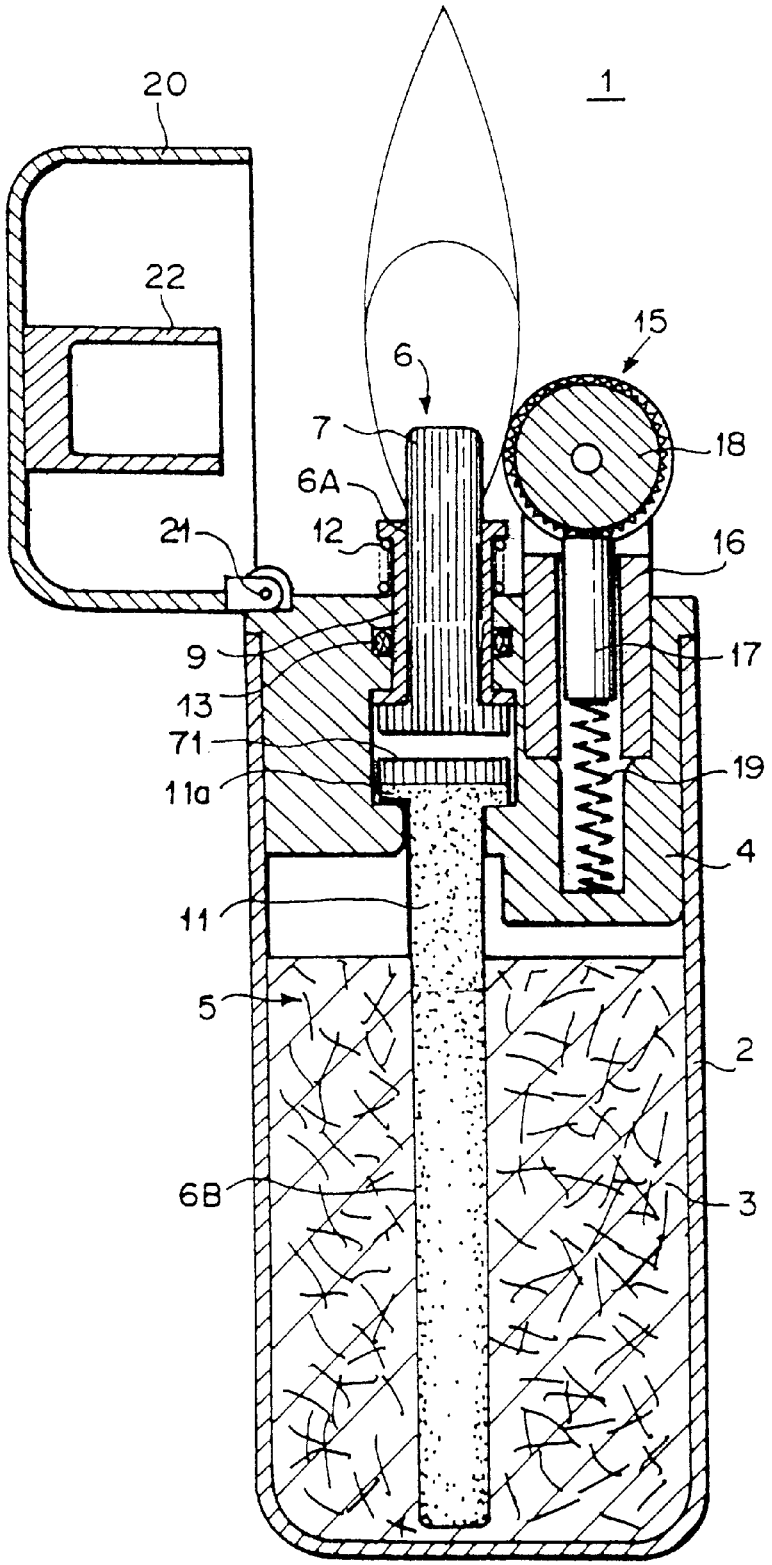
FIG. 4 is a schematic sectional view showing a third embodiment of the combustion appliance for a liquid fuel in accordance with the present invention, which takes on the form of a lighter.

As illustrated in FIG. 4, in the third embodiment of the combustion appliance (the lighter 1), as in the second embodiment, the entire region of the burning section side subdivision 6A of the combustion wick 6 is constituted of the burning member 7 made from the heat-resistant material. Also, the top end portion of the head 11*a* of the sucking member 11, which is made from the porous material, in the sucking section side subdivision 6B is constituted of a contact member 71, which is made from the same material as that of the burning member 7. The other features are the same as those in the first embodiment.

<Fourth embodiment>

Figure 5:
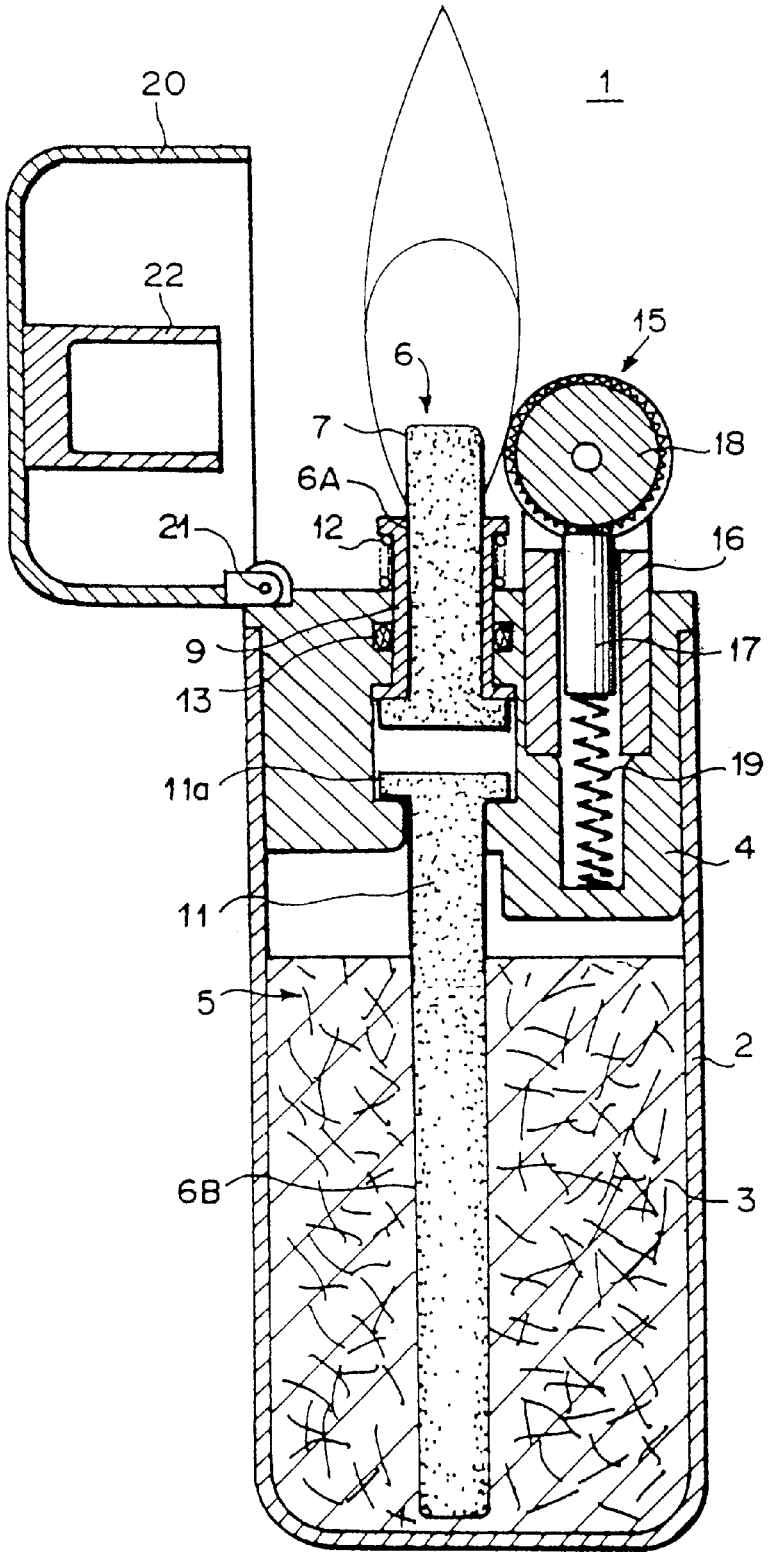
FIG. 5 is a schematic sectional view showing a fourth embodiment of the combustion appliance for a liquid fuel in accordance with the present invention, which takes on the form of a lighter.

As illustrated in FIG. 5, in the fourth embodiment of the combustion appliance (the lighter 1), the combustion wick 6 is divided into the burning section side subdivision 6A and the sucking section side subdivision 6B as in the aforesaid embodiments. Both of the burning section side subdivision 6A and the sucking section side subdivision 6B are made from the same material, which has heat resistance and sucking characteristics, e.g., heat-resistant fibers, such as ceramic fibers, glass fibers, or carbon fibers.

By way of example, as the heat-resistant fibers, ceramic fibers having a thickness of 2.8 $\mu$m may be formed from a raw material, which principally contains alumina and silica, and a small amount of an organic binder may be added to the ceramic fibers. The thus obtained ceramic fibers may be formed into a predetermined shape, such that the packing density may be 200 mg/cm$^3$.

<Fifth embodiment>

Figure 6A:
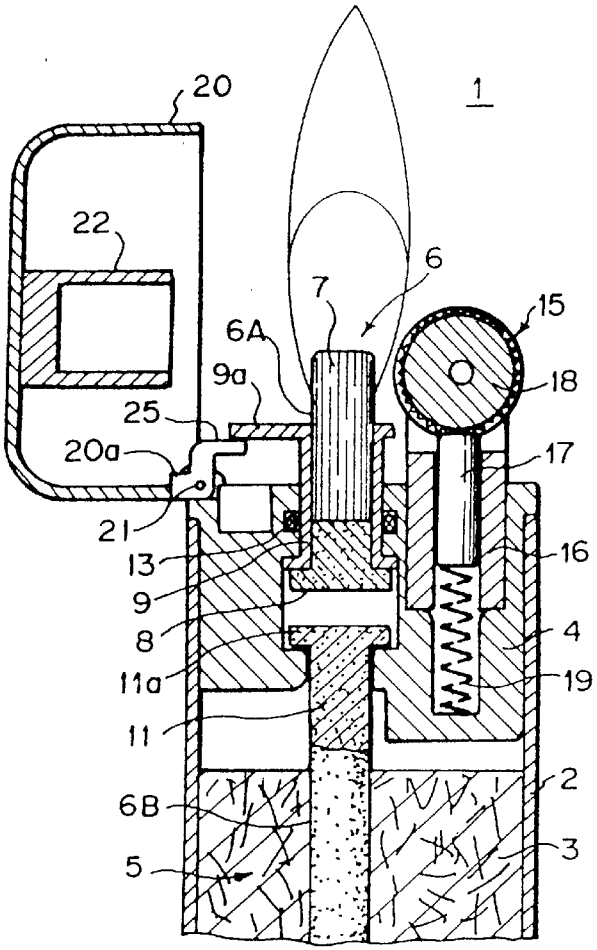
FIG. 6A is a schematic sectional view showing a fifth embodiment of the combustion appliance for a liquid fuel in accordance with the present invention, which takes on the form of a lighter and is in a combustion state.
Figure 6B:
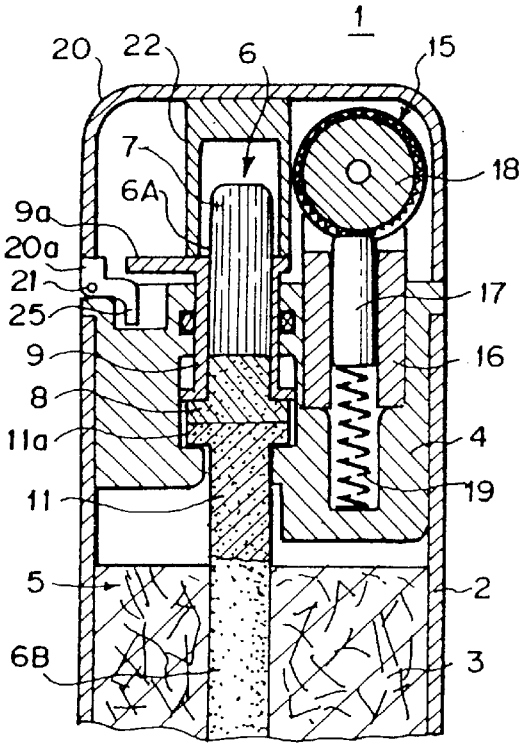
FIG. 6B is a schematic sectional view showing the lighter of FIG. 6A, which is in a non-use state.

As illustrated in FIGS. 6A and 6B, in the fifth embodiment of the combustion appliance (the lighter 1), the sliding mechanism for the burning section side subdivision 6A of the combustion wick 6, which mechanism is associated with the opening and closing operations of the closure cap 20, is different from that in the first embodiment and is not provided with the resilient means.

The basic structure of the combustion wick 6 and the structures of the fuel storing section 5 and the lighting means 15 are the same as those in the first embodiment. The burning section side subdivision 6A of the combustion wick 6 is inserted for the sliding movement into the through-hole of the upper cover 4. An engagement portion 9*a* is formed at the upper end portion of the sliding member 9. The engagement portion 9*a* extends toward a pivotably supported portion 20*a* of the closure cap 20. The pivotably supported portion 20*a* of the closure cap 20 is provided with a lever-like interlocking member 25, which is rotated upwardly and downwardly by the opening and closing operations of the closure cap 20.

The interlocking member 25 of the closure cap 20 can engage with the engagement portion 9*a* at the burning section side subdivision 6A of the combustion wick 6. As illustrated in FIG. 6A, when the closure cap 20 is opened, the interlocking member 25 is rotated upwardly and brought into contact with the engagement portion 9*a*. The interlocking member 25 thus pushes the engagement portion 9*a* up and causes the burning section side subdivision 6A to move upwardly. As a result, the burning section side subdivision 6A is separated from the sucking section side subdivision 6B, and the feeding of the fuel from the sucking section side subdivision 6B to the burning section side subdivision 6A is blocked.

As illustrated in FIG. 6B, when the closure cap 20 is closed, the interlocking member 25 is rotated downwardly and disengaged from the engagement portion 9*a* at the burning section side subdivision 6A. Also, the abutment member 22 of the closure cap 20 comes into contact with the upper end of the sliding member 9 at the burning section side subdivision 6A and pushes the sliding member 9 down. The burning section side subdivision 6A is thus moved downwardly, its lower end is brought into contact with the upper end of the sucking section side subdivision 6B, and the sucked-up fuel is fed from the sucking section side subdivision 6B to the burning section side subdivision 6A.

The other features of the structure are the same as those in the first embodiment. In FIGS. 6A and 6B, similar elements are numbered with the same reference numerals with respect to FIG. 1. Also, with respect to the automatic fire extinguishment after the combustion has been carried out for a predetermined length of time, and the like, the same effects as those with the first embodiment can be obtained.

<Sixth embodiment>

Figure 7:
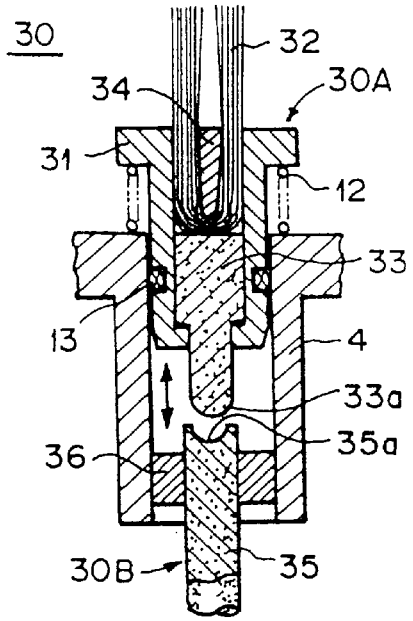
FIG. 7 is a schematic sectional view showing a combustion wick region in a sixth embodiment of the combustion appliance for a liquid fuel in accordance with the present invention.

As illustrated in FIG. 7, in the sixth embodiment of the combustion appliance in accordance with the present invention, the structure of the combustion wick is different from that shown in FIG. 1. In FIG. 7, only the major parts are shown. The other parts of the combustion appliance are constituted in the same manner as that in FIG. 1.

A combustion wick 30 is divided at an intermediate position into a burning section side subdivision 30A and a sucking section side subdivision 30B, such that the burning section side subdivision 30A can be moved in the direction that comes into contact with the sucking section side subdivision 30B and in the direction that separates from the sucking section side subdivision 30B.

The burning section side subdivision 30A comprises a burning member 32, which is located at the upper part, and a fuel retaining member 33, which is located at the lower part. The burning member 32 and the fuel retaining member 33 are secured to a cylindrical sliding member 31. The fuel retaining member 33 is made from a sintered material of polyethylene powder or from a fiber material.

The burning member 32 is formed by bundling glass fiber threads, bending the bundle at its intermediate part, inserting the bent portion of the bundle into the sliding member 31, pushing a wedge-like securing member 34 into the space, which is defined by the bent portion of the bundle having been inserted into the sliding member 31, and thereby securing the bent portion of the bundle. The lower end portion of the burning member 32 is in contact with the upper end of the fuel retaining member 33.

The lower end portion of the fuel retaining member 33 extends downwardly from the bottom of the sliding member 31. A lower end face 33*a* of the fuel retaining member 33 constitutes a convex curved surface. A sucking member 35 of the sucking section side subdivision 30B is made from a sintered material of polyethylene powder or from a fiber material. A lower end portion of the sucking member 35 is inserted into the fuel storing section 5. An upper end portion of the sucking member 35 is supported in the through-hole of the upper cover 4 with a sealing member 36 intervening therebetween. An upper end face 35*a* of the sucking member 35 constitutes a concave curved surface and comes into contact with the lower end face 33*a* of the fuel retaining member 33.

With the burning member 32 of the burning section side subdivision 30A, the fuel burning rate, the flame shape, and the flame length are set by the thickness, the number, and the length of the glass fibers constituting the burning member 32. Also, the length of time, over which the combustion can continue before the fire goes out, is set by the size of the fuel retaining member 33. As for the sucking member 35 of the sucking section side subdivision 30B, the state of formation of internal pores depends upon the thickness of the sucking member 35, the particle diameter of the sintered polyethylene powder, the sintering density, and the like. The fuel sucking and feeding characteristics of the sucking member 35 are set by these factors.

For example, in cases where the combustion wick 30 is the one incorporated in the lighter 1 for smoker's requisites, the burning member 32 is made from glass fibers having a thickness of 6 $\mu$m, a fiber density (i.e., a weight per unit area) of 150 mg/cm$^3$, and a length of 20 mm. A bundle of the glass fibers is bent at its middle part, and a bent bundle having an outer diameter of 3 mm and a length of 10 mm is thereby obtained. The bent bundle is then inserted into the sliding member 31, such that the bent bundle may be projected by a length of 5 mm from the top end of the sliding member 31. The sucking member 35 is formed by introducing the polyethylene powder, which is a mixture of particles having particle sizes of 70 to 200 mesh and has an average particle size of 140 mesh, into a mold, and sintering the polyethylene powder at 170° C. for 10 minutes.

As described above, the lower end face 33*a* of the fuel retaining member 33 of the burning section side subdivision 30A and the upper end face 35*a* of the sucking member 35 of the sucking section side subdivision 30B, which end faces are brought into contact with each other, are constituted by the curved surfaces. Therefore, the contact area of the contact end faces becomes large, the fuel feeding capacity can be kept large, and the fuel feeding can be carried out quickly after the end faces are brought into contact with each other.

<Seventh embodiment>

Figure 8:
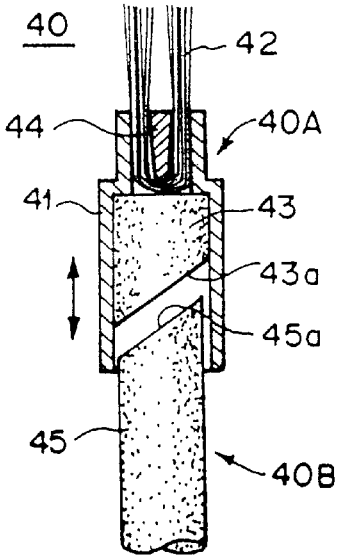
FIG. 8 is a schematic sectional view showing a combustion wick region in a seventh embodiment of the combustion appliance for a liquid fuel in accordance with the present invention.

As illustrated in FIG. 8, in the seventh embodiment, a further different type of combustion wick is employed. A combustion wick 40 is divided into a burning section side subdivision 40A and a sucking section side subdivision 40B. Though not shown in detail, the burning section side subdivision 40A can be moved in the direction that comes into contact with the sucking section side subdivision 40B and in the direction that separates from the sucking section side subdivision 40B.

The burning section side subdivision 40A comprises a burning member 42, which is made from glass fibers, and a fuel retaining member 43, which is made from a sintered material of polyethylene powder. The burning member 42 is secured to an upper part of a cylindrical sliding member 41 by a securing member 44 pushed into the space, which is defined by the bent portion of the burning member 42 having been inserted into the sliding member 41. The fuel retaining member 43 is secured to the lower part of the sliding member 41.

A sucking member 45 of the sucking section side subdivision 40B is made from a sintered material of polyethylene powder, or the like, and is formed into a rod-like shape. An upper end face 45*a* of the sucking member 45 and a lower end face 43*a* of the fuel retaining member 43 are formed as the oblique surfaces. The contact area of the end faces is thereby kept large, and the fuel feeding capacity is enhanced.

<Eighth embodiment>

Figure 9:
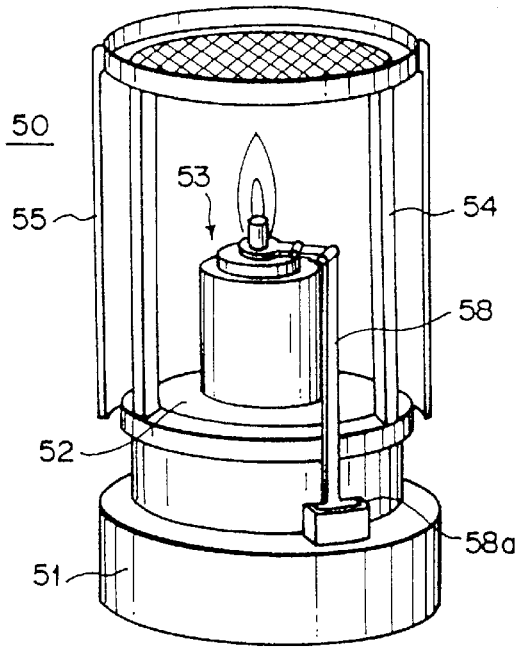
FIG. 9 is a schematic perspective view showing an eighth embodiment of the combustion appliance for a liquid fuel in accordance with the present invention.
Figure 10:
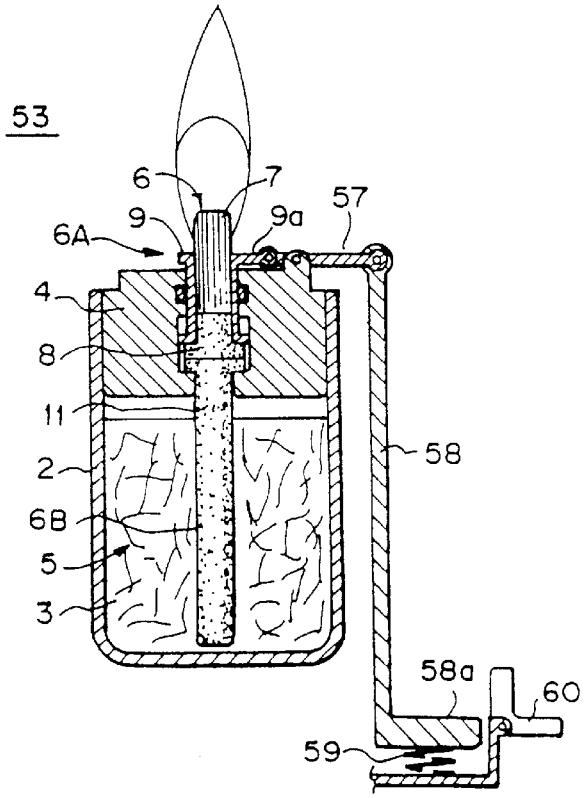
FIG. 10 is a schematic sectional view showing a burning section main body in the embodiment of FIG. 9, FIGS. 11, 12, and 13 are graphs showing the results obtained from combustion tests carried out in Experimental Example 1.

As illustrated in FIGS. 9 and 10, the eighth embodiment of the combustion appliance in accordance with the present invention is used in the same manner as that in a candlestand or a light.

A combustion appliance 50 comprises a bed 51, a support base 52 located on the bed 51, and a combustion appliance main body 53 located on the support base 52. Also, a frame 54 and a plate material 55 is erected at the outer periphery of the support base 52.

As illustrated in FIG. 10, the combustion appliance main body 53 comprises the tank 2 filled with the fiber material 3, and the upper cover 4 secured to the upper part of the tank 2. The region defined by the tank 2 and the upper cover 4 serves as the fuel storing section 5 for storing the liquid fuel. The combustion wick 6, which has the same structure as that in the aforesaid fifth embodiment (shown in FIG. 6A), is inserted through the upper cover 4.

The burning section side subdivision 6A of the combustion wick 6 located such that it can be slid vertically in the direction that comes into contact with the sucking section side subdivision 6B and in the direction that separates from the sucking section side subdivision 6B. The engagement portion 9*a* of the sliding member 9 is connected to a fire extinguishing lever 58 via a link 57. The link 57 is pivotably supported at an intermediate part. One end of the link 57 is connected to the engagement portion 9*a* of the sliding member 9, and the other end thereof is connected to the upper end of the fire extinguishing lever 58, which extends vertically. The lower end portion of the fire extinguishing lever 58 is bent to the horizontal direction and constitutes an operating portion 58*a*.

The operating portion 58*a* of the fire extinguishing lever 58 is urged upwardly by a spring 59. In the ordinary state, the burning section side subdivision 6A is thereby set at the lowered position and in contact with the sucking section side subdivision 6B. When the fire extinguishing lever 58 is pushed down, the link 57 is rotated, and the engagement portion 9*a* is raised. Also, the burning section side subdivision 6A is moved up and separated from the sucking section side subdivision 6B. The combustion appliance main body 53 is not provided with a lighting means and is lighted with a match, a lighter, or the like.

With the combustion appliance 50, in the ordinary state in which the fire extinguishing lever 58 is not pushed down, the burning section side subdivision 6A of the combustion wick 6 is set at the lowered position, its lower end is in contact with the sucking section side subdivision 6B, and the sucked-up liquid fuel is fed from the sucking section side subdivision 6B to the burning section side subdivision 6A. When the burning member 7 is lighted, the combustion is carried out continuously with a flame being produced.

When the fire is to be extinguished, the fire extinguishing lever 58 is pushed down. As a result, the burning section side subdivision 6A is raised and separated from the sucking section side subdivision 6B, and the fuel feeding is blocked. Therefore, the fire is extinguished after the combustion has been carried out for a predetermined length of time. At this time, the fire extinguishing lever 58 is pushed down continuously or is locked at the fire extinguishing position by the rotation of a locking member 60.

In the mechanism for merely extinguishing the fire as in the combustion appliance 50, the fuel retaining member 8 need not necessarily be provided at the burning section side subdivision 6A. Specifically, the lower end of the burning member 7 may be directly brought into contact with the sucking section side subdivision 6B, and the combustion time, which occurs after the burning section side subdivision 6A has been separated from the sucking section side subdivision 6B, may be kept short. Also, a timer may be utilized, such that the fire extinguishing operation may be carried out after the combustion has been carried out for the time having been set by the timer.

By way of example, as the liquid fuel in the embodiments described above, it is possible to employ an alcohol fuel, which contains, as a principal constituent, an alcohol, such as a lower monohydric alcohol selected from the group consisting of methyl alcohol, ethyl alcohol, and propyl alcohol, and contains at least one kind of hydrocarbon compound having approximately the same boiling point as that of the principal constituent, such as a saturated hydrocarbon selected from the group consisting of hexane, heptane, octane, nonane, cyclohexadiene, and cycloheptene. With an alcohol alone, a colorless combustion flame is produced. By the addition of the saturated hydrocarbon described above, the top end portion of the combustion flame is imparted with a yellow-orange color due to high-temperature light emission of liberated carbon.

It is also possible to employ a liquid fuel, which is composed of at least one kind of compound selected from the group consisting of heptane, octane, and nonane. A liquid fuel composed of a benzine type of hydrocarbon may also be employed.

In the experimental examples described below, the aforesaid lighter for smoker's requisites was used, and the relationship between the size of the fuel reservoir, i.e. the fuel retaining member, at the burning section side subdivision and the combustion time, which occurs before the automatic fire extinguishment, was investigated. In accordance with the obtained results, a change in flame length and the combustion time were designed.

EXPERIMENTAL EXAMPLE 1

The experiments were carried out by using the combustion wick of the type shown in FIG. 8 (the contact faces were perpendicular surfaces). The outer diameter of the fuel retaining member at the burning section side subdivision was set at 2.0 mm, 3.0 mm, and 4.0 mm, and the length of the fuel retaining member was set at 10 mm, 5 mm, and 2.5 mm. In accordance with the setting of the outer diameter and the length of the fuel retaining member, the outer diameter of the sucking member was set at 2.0 mm, 3.0 mm, and 4.0 mm. A change in flame length with respect to the combustion time was measured after the burning section side subdivision was separated from the sucking section side subdivision. Experiments were also carried out in the same manner with respect to a combustion wick, which was not provided with the fuel retaining member and in which the burning member directly came into contact with the sucking member.

Figure 11:
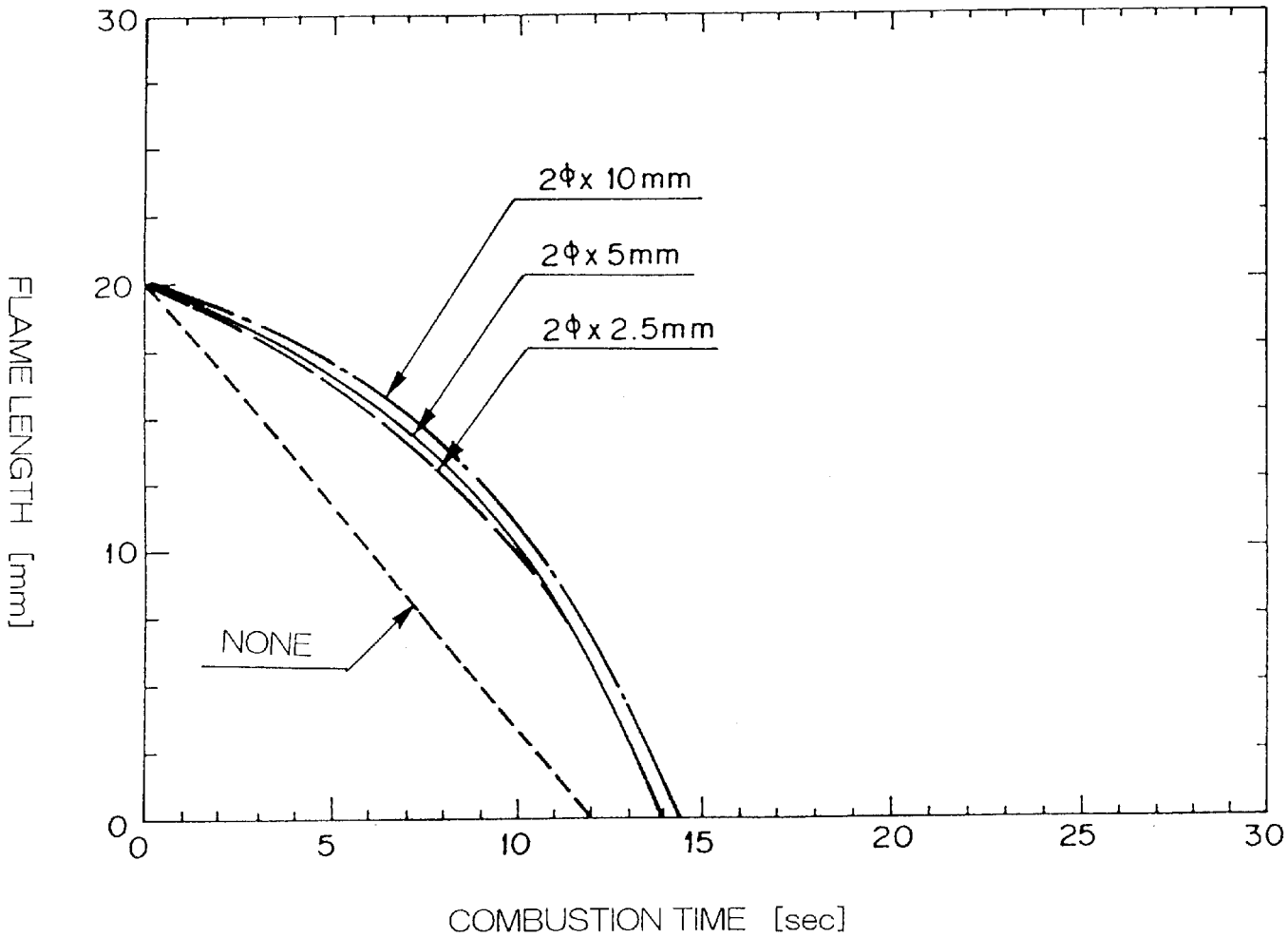
Figure 12:
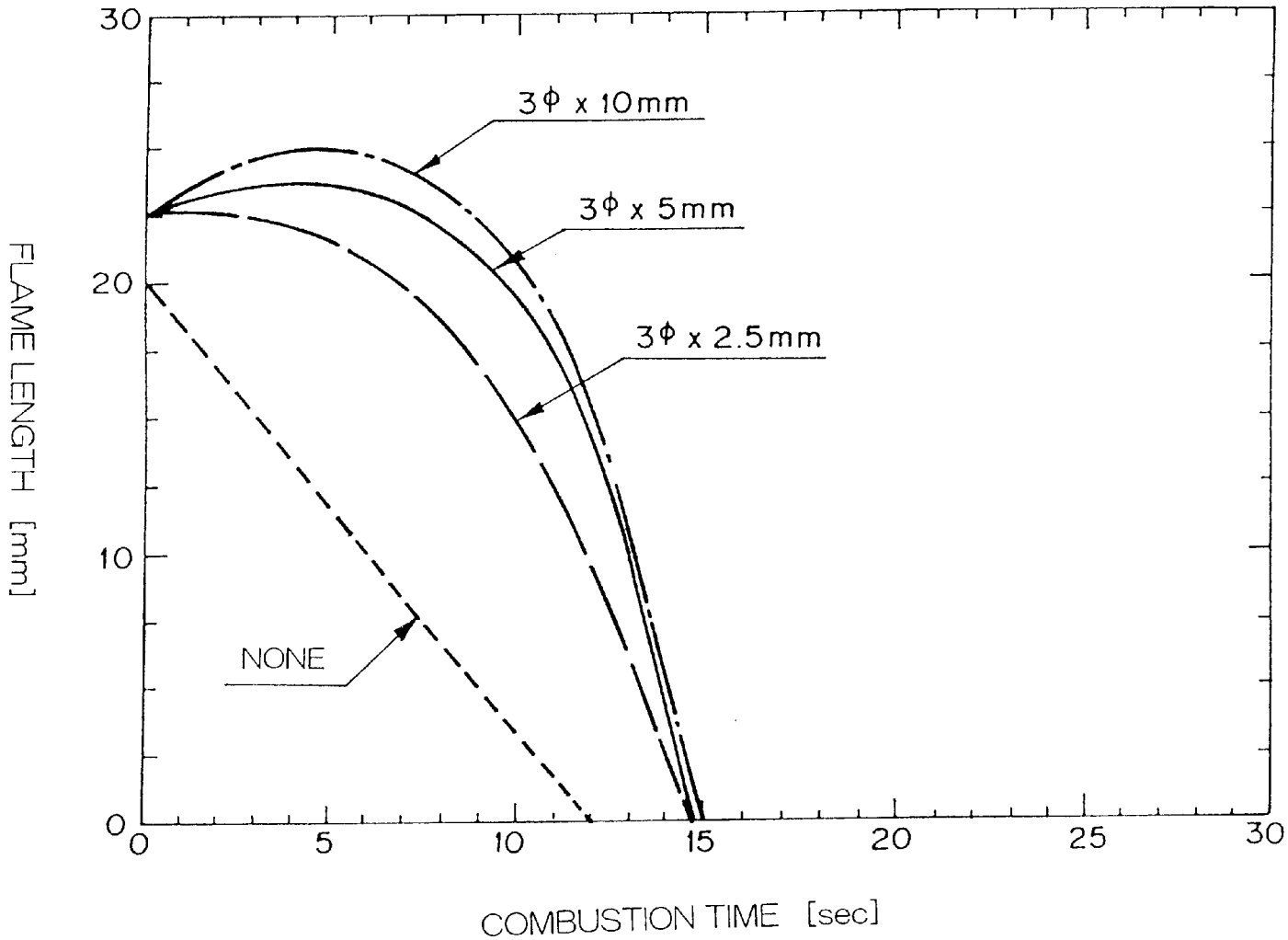
Figure 13:
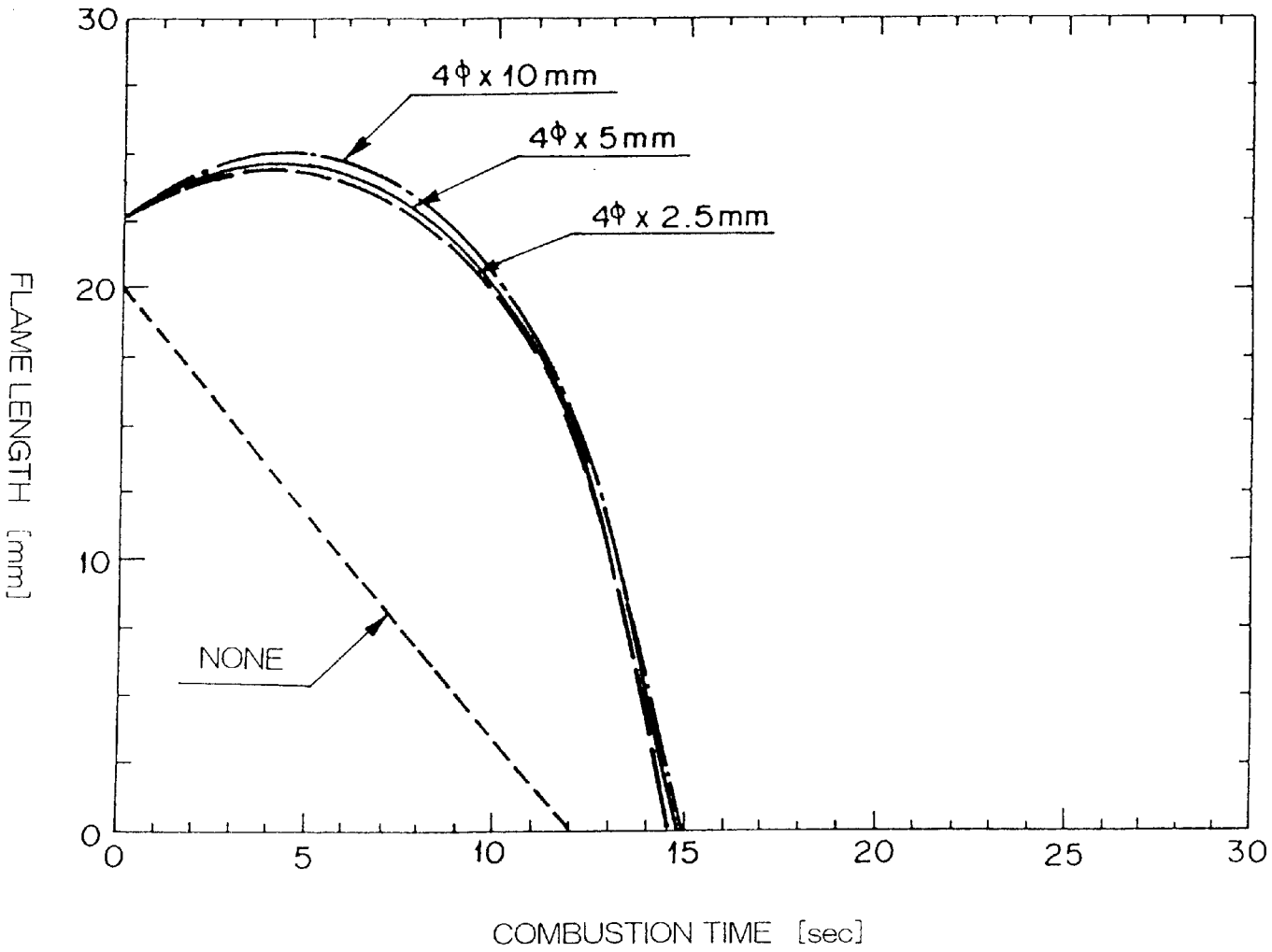

The results shown in FIGS. 11, 12, and 13 were obtained. As for the experiment conditions, the basic structure of the lighter was the same as that shown in FIG. 1. The alcohol fuel (95 wt % ethyl alcohol +5 wt % n-hexane) was used as the liquid fuel. The fiber material contained in the fuel storing section was polypropylene fibers (thickness: 1 to 2 denier, density: 0.1 g/cm$^3$). The burning member of the combustion wick was made by bundling glass fibers and bending the bundle at its middle part. Specifically, the glass fibers each having a diameter of 6 $\mu$m were bundled such that the fiber density (i.e., the weight per unit area) might be 150 mg/cm$^3$. The bundle of the glass fibers was bent into a bent bundle having an outer diameter of 3 mm and a length of 10 mm. The bent bundle was then inserted into the sliding member, such that the bent bundle might be projected by a length of 5 mm from the top end of the sliding member, and such that an initial flame length might be approximately 20 mm. The sucking member was made by sintering polyethylene powder. Specifically, the powder having the same particle diameter as that described above was sintered under the same temperature conditions.

FIG. 11 shows the results obtained when the outer diameter of the fuel retaining member was 2 mm. Since the outer diameter of the fuel retaining member was small, the flame length sharply became short with the passage of the combustion time. FIG. 12 shows the results obtained when the outer diameter of the fuel retaining member was 3 mm. Since the outer diameter of the fuel retaining member was large, the flame length was kept for a long time. FIG. 13 shows the results obtained when the outer diameter of the fuel retaining member was 4 mm. Since the outer diameter of the fuel retaining member was set to be large even further, stable characteristics were obtained.

From the results described above, it was found that the functions, with which the fire is extinguished automatically after the predetermined combustion is carried out and the use as the combustion appliance is finished, could be obtained. Also, it was found that the necessary adjustments for a change in flame length, and the like, can be carried out.

EXPERIMENTAL EXAMPLE 2

The experiments were carried out by using the lighter and the combustion wick (the contact faces were oblique surfaces), which were of the same types as those in Experimental Example 1. In the experiments, after the fire was extinguished automatically, the burning section side subdivision was brought into contact with the sucking section side subdivision. After a predetermined length of contact time has elapsed, the burning section side subdivision was separated from the sucking section side subdivision and lighted. In this state, a change in flame length with respect to the passage of combustion time was measured.

In the experiments, the outer diameter of the fuel retaining member of the burning section side subdivision was 4.0 mm. The contact end face of the fuel retaining member was formed by cutting the member at an angle of 45° at the parts of the lengths of 2 mm to 4 mm. In accordance with the fuel retaining member, the outer diameter of the sucking section side subdivision was set to be 4 mm.

Figure 14:
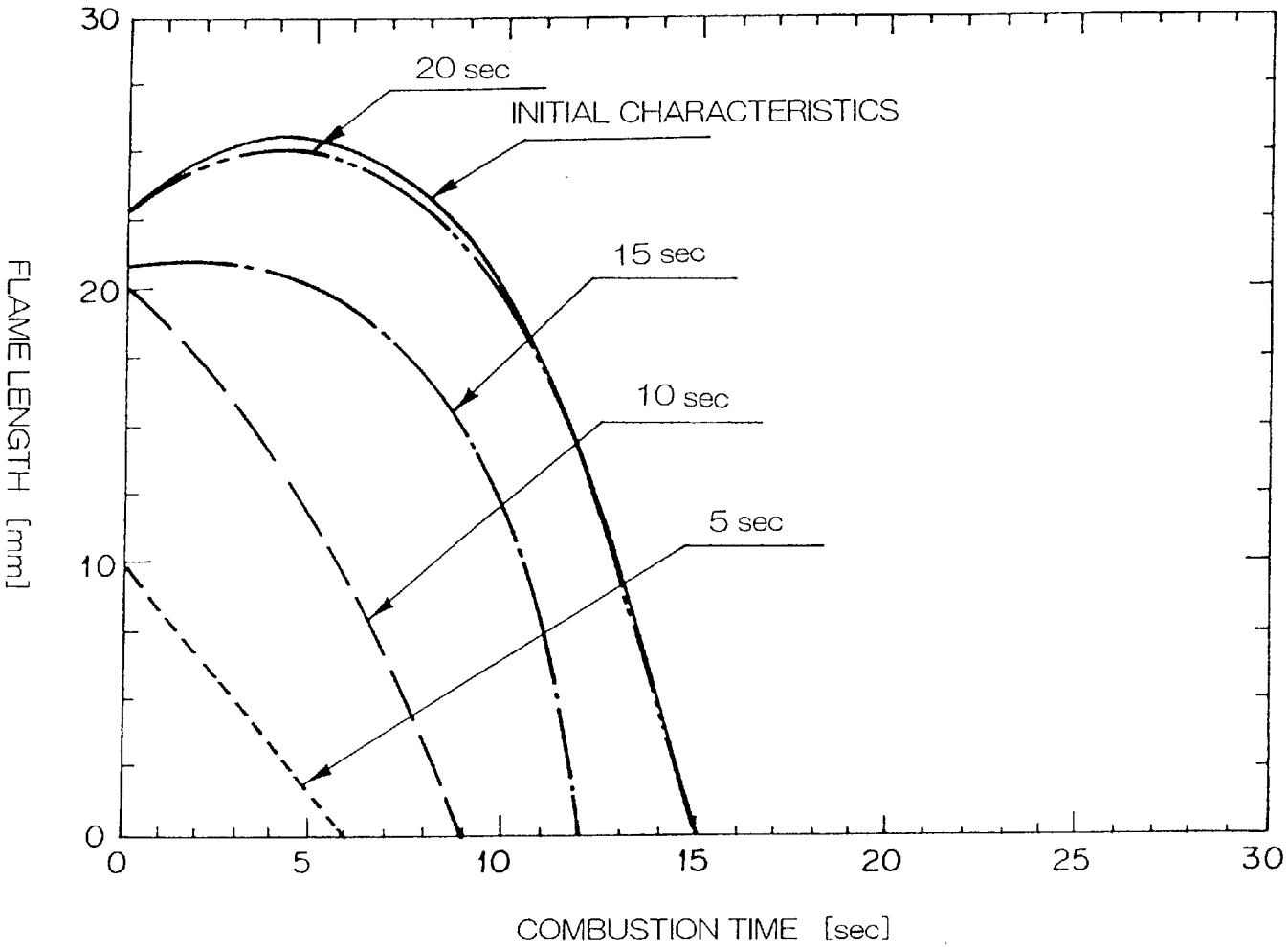
FIG. 14 is a graph showing the results obtained from a combustion test carried out in Experimental Example 2.

The results shown in FIG. 14 were obtained. With the contact time of 20 seconds, the same characteristics as the initial characteristics were obtained. It was thus found that the combustion appliance can be designed to have the characteristics corresponding to the purposes of use.

We claim:

1. A combustion appliance for a liquid fuel, which is provided with a combustion wick comprising a sucking section for sucking up a liquid fuel by the utilization of capillarity and a burning section for burning the sucked-up liquid fuel, wherein the combustion wick is divided at an intermediate position into a sucking section side subdivision and a burning section side subdivision and is located such that at least either one of said sucking section side subdivision and said burning section side subdivision can be moved in a direction that comes into contact with the other and in a direction that separates it from the other, the liquid fuel being fed from said sucking section side subdivision to said burning section side subdivision when they arc brought into contact with each other, the feeding of the liquid fuel being blocked when said sucking section side subdivision and said burning section side subdivision are separated from each other, whereby a combustion time is limited, wherein the separation of said sucking section side subdivision and said burning section side subdivision from each other is carried out in association with an operation for lighting the burning section of the combustion wick.

2. A combustion appliance for a liquid fuel, which is provided with a combustion wick comprising a sucking section for sucking up a liquid fuel by the utilization of capillarity and a burning section for burning the sucked-up liquid fuel, wherein the combustion wick is divided at an intermediate position into a sucking section side subdivision and a burning section side subdivision and is located such that at least either one of said sucking section side subdivision and said burning section side subdivision can be moved in a direction that comes into contact with the other and in a direction that separates from the other, the movements being carried out in association with opening and closing operations of a closure cap for closing the burning section, the liquid fuel being fed from said sucking section side subdivision to said burning section side subdivision when they are brought into contact with each other, the feeding of the liquid fuel being blocked when said sucking section side subdivision and said burning section side subdivision are separated from each other, whereby a combustion time is limited.

3. A combustion appliance as defined in claim 2 wherein said burning section side subdivision of the combustion wick is urged by a resilient means to the direction that separates from said sucking section side subdivision, and said burning section side subdivision is moved in the direction that comes into contact with said sucking section side subdivision and in association with the closing operation of said closure cap.

4. A combustion appliance as defined in claim 2 wherein said burning section side subdivision of the combustion wick is brought into contact with said sucking section side subdivision when said closure cap is closed, and said burning section side subdivision is moved in the direction that separates from said sucking section side subdivision and in association with the opening operation of said closure cap.

5. A combustion appliance as defined in claim 1 or 2 wherein the divided end faces of the combustion wick constitute oblique surfaces or curved surfaces.

6. A combustion appliance as defined in claim 1 or 2 wherein a fuel reservoir is located at an intermediate position in the combustion wick, and the combustion wick is divided at a position closer to the sucking section than said fuel reservoir.

7. A combustion appliance as defined in claim 1 or 2 wherein the burning section and the sucking section of the combustion wick contain different materials, and a portion of said sucking section side subdivision adjacent to the burning section side subdivision contains the same material as said burning section side subdivision, such that at least either one of said sucking section side subdivision and said burning section side subdivision can be moved in the direction that comes into contact with the other and in the direction that separates it from the other.

8. A combustion appliance as defined in claim 1 or 2 wherein the burning section and the sucking section of the combustion wick contain different materials, and a portion of said burning section side subdivision adjacent to the sucking section side subdivision contains the same material as the sucking section side subdivision such that at least either one of said sucking section side subdivision and said burning section side subdivision can be moved in the direction that comes into contact with the other and in the direction that separates from the other.

9. A combustion appliance as defined in claim 1 or 2 wherein the burning section and the sucking section of the combustion wick are made from different materials, and the combustion wick is divided at a boundary between the material, which constitutes the sucking section, and the material, which constitutes the burning section, into said sucking section side subdivision and said burning section side subdivision, such that at least either one of said sucking section side subdivision and said burning section side subdivision can be moved in the direction that comes into contact with the other and in the direction that separates from the other.

10. A combustion appliance as defined in claim 1 or 2 wherein the burning section and the sucking section of the combustion wick are made from the same material, and the combustion wick is divided at an intermediate position in the material into said sucking section side subdivision and said burning section side subdivision, such that at least either one of said sucking section side subdivision and said burning section side subdivision can be moved in the direction that comes into contact with the other and in the direction that separates from the other.

* * * * *